US011197501B1

(12) United States Patent
Washington

(10) Patent No.: US 11,197,501 B1
(45) Date of Patent: Dec. 14, 2021

(54) PERSONAL VAPORIZER HAVING MULTIPLE LIQUID-HOLDING RESERVOIRS

(71) Applicant: Davone Washington, Aurora, CO (US)

(72) Inventor: Davone Washington, Aurora, CO (US)

( * ) Notice: Subject to any disclaimer, the term of this patent is extended or adjusted under 35 U.S.C. 154(b) by 444 days.

(21) Appl. No.: 16/247,670

(22) Filed: Jan. 15, 2019

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 40/42*** | (2020.01) |
| ***H05B 1/02*** | (2006.01) |
| ***A24D 1/14*** | (2006.01) |
| ***A24F 40/40*** | (2020.01) |

(52) U.S. Cl.
CPC ..... *A24F 40/42* (2020.01); *A24D 1/14* (2013.01); *A24F 40/40* (2020.01); *H05B 1/0297* (2013.01)

(58) Field of Classification Search
CPC ..... A24F 40/42; A24F 40/40
See application file for complete search history.

(56) References Cited

U.S. PATENT DOCUMENTS

| | | | | |
|---|---|---|---|---|
| D695,450 | S | 12/2013 | Benassayag | |
| 9,271,528 | B2 | 3/2016 | Liu | |
| 9,333,311 | B2 * | 5/2016 | Liu | A61M 15/06 |
| 2014/0060556 | A1 * | 3/2014 | Liu | A24F 40/44 131/329 |
| 2014/0190503 | A1 * | 7/2014 | Li | A24F 40/46 131/329 |
| 2014/0366898 | A1 * | 12/2014 | Monsees | A24F 40/30 131/329 |
| 2015/0257451 | A1 | 9/2015 | Brannon | |
| 2016/0106936 | A1 * | 4/2016 | Kimmel | A24F 40/51 128/202.21 |
| 2017/0143042 | A1 * | 5/2017 | Batista | H05B 3/26 |
| 2017/0258132 | A1 * | 9/2017 | Rostami | A24F 40/42 |
| 2017/0265525 | A1 | 9/2017 | Li | |
| 2018/0168227 | A1 * | 6/2018 | Fraser | A24F 40/465 |
| 2018/0184712 | A1 * | 7/2018 | Fraser | A24F 40/44 |
| 2018/0192700 | A1 * | 7/2018 | Fraser | A24F 40/465 |
| 2018/0352862 | A1 * | 12/2018 | Mironov | A24F 40/465 |
| 2020/0029618 | A1 * | 1/2020 | Fraser | A61M 11/042 |
| 2020/0146352 | A1 * | 5/2020 | Alston | A24F 40/57 |
| 2020/0229492 | A1 * | 7/2020 | Wilson | A24F 40/30 |

* cited by examiner

*Primary Examiner* — Abdullah A Riyami
*Assistant Examiner* — Thang H Nguyen

(57) ABSTRACT

The personal vaporizer having multiple liquid-holding reservoirs generates a consumable substance in a gas phase to simulate the smoking experience. The consumable substance is contained within a cartridge selected from a plurality of cartridges that are contained within the personal vaporizer having multiple liquid-holding reservoirs. Each cartridge contains a different consumable substance. The personal vaporizer having multiple liquid-holding reservoirs allows a user to select the desired consumable substance. The personal vaporizer having multiple liquid-holding reservoirs comprises a plurality of containment prisms, a manifold, a plurality of threaded connections, and the plurality of cartridges. The plurality of containment prisms contain the plurality of cartridges and the mechanisms required to process the consumable substance. The process is selected from the group consisting of evaporating the consumable substance and sublimating the consumable substance. The manifold creates a fluidic connection between the plurality of cartridges and the user of the plurality of cartridges.

18 Claims, 4 Drawing Sheets

PERSONAL VAPORIZER HAVING MULTIPLE LIQUID-HOLDING RESERVOIRS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of tobacco and smoker's requisites not otherwise provided for, more specifically, a simulated smoking device comprising an electrical heating device. (A24F47/008)

SUMMARY OF INVENTION

The personal vaporizer having multiple liquid-holding reservoirs is a vaporizing device. The personal vaporizer having multiple liquid-holding reservoirs vaporizes a smoking material used to simulate the smoking experience. The personal vaporizer having multiple liquid-holding reservoirs generates a consumable substance in a gas phase. The gas phase of the consumable substance is assumed to be a pharmacologically active cartridge. The cartridge is selected from a plurality of cartridges that are contained within the personal vaporizer having multiple liquid-holding reservoirs. Each cartridge contained within the personal vaporizer having multiple liquid-holding reservoirs contains a different consumable substance. The personal vaporizer having multiple liquid-holding reservoirs allows a user to select the desired consumable substance from an appropriate cartridge selected from the plurality of cartridges.

The personal vaporizer having multiple liquid-holding reservoirs comprises a plurality of containment prisms, a manifold, a plurality of threaded connections, and the plurality of cartridges. The plurality of containment prisms contain the plurality of cartridges and the mechanisms required to process the consumable substance. The process is selected from the group consisting of evaporating the consumable substance and sublimating the consumable substance. The manifold creates a fluidic connection between the plurality of cartridges and the user of the plurality of cartridges.

These together with additional objects, features and advantages of the personal vaporizer having multiple liquid-holding reservoirs will be readily apparent to those of ordinary skill in the art upon reading the following detailed description embodiments when taken in conjunction with the accompanying drawings.

In this respect, before explaining the current embodiments of the personal vaporizer having multiple liquid-holding reservoirs in detail, it is to be understood that the personal vaporizer having multiple liquid-holding reservoirs is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the personal vaporizer having multiple liquid-holding reservoirs.

It is therefore important that the claims be regarded as including such equivalent construction insofar as they do not depart from the spirit and scope of the personal vaporizer having multiple liquid-holding reservoirs. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
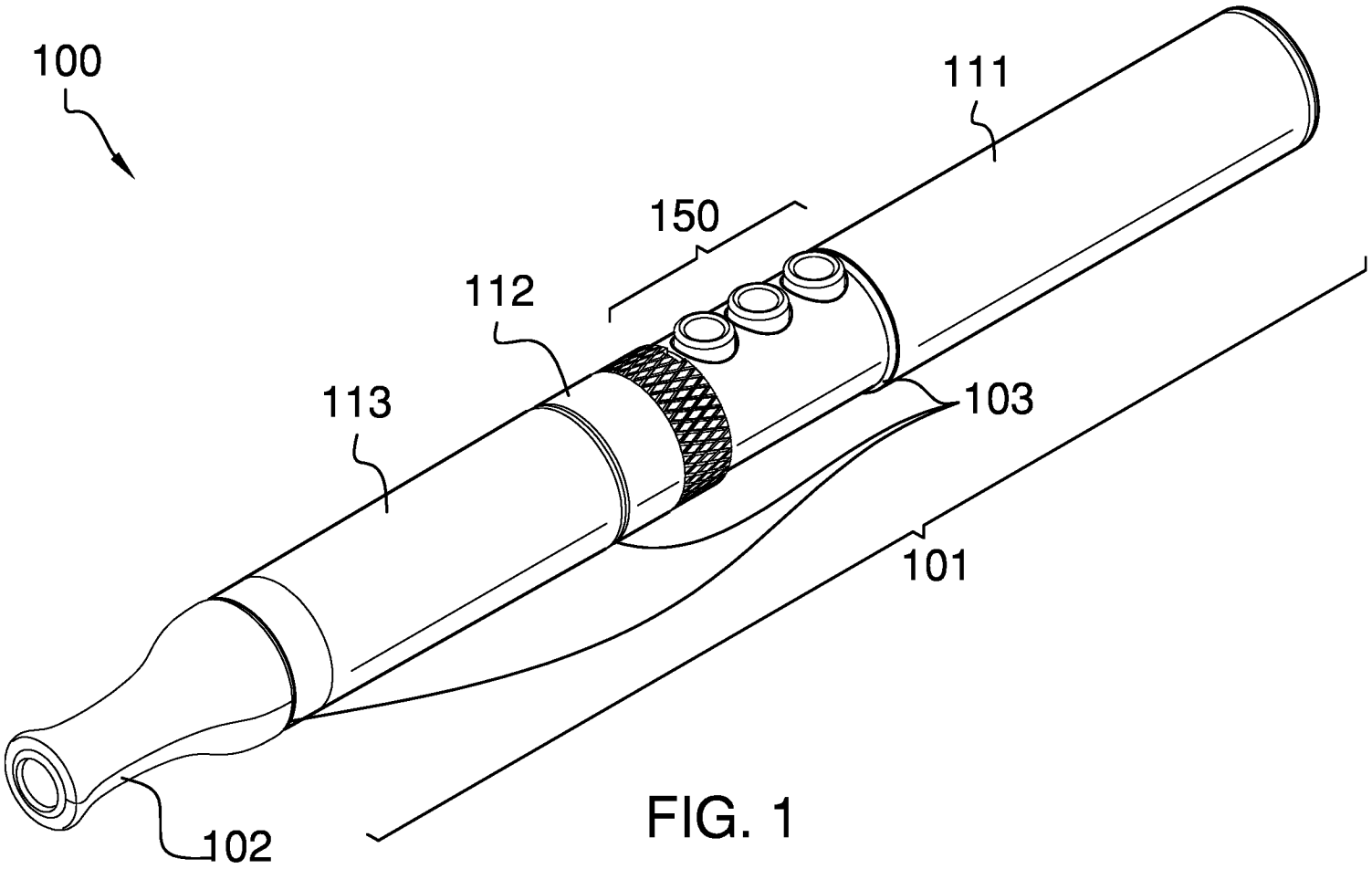
FIG. 1 is a perspective view of an embodiment of the disclosure.
Figure 2:
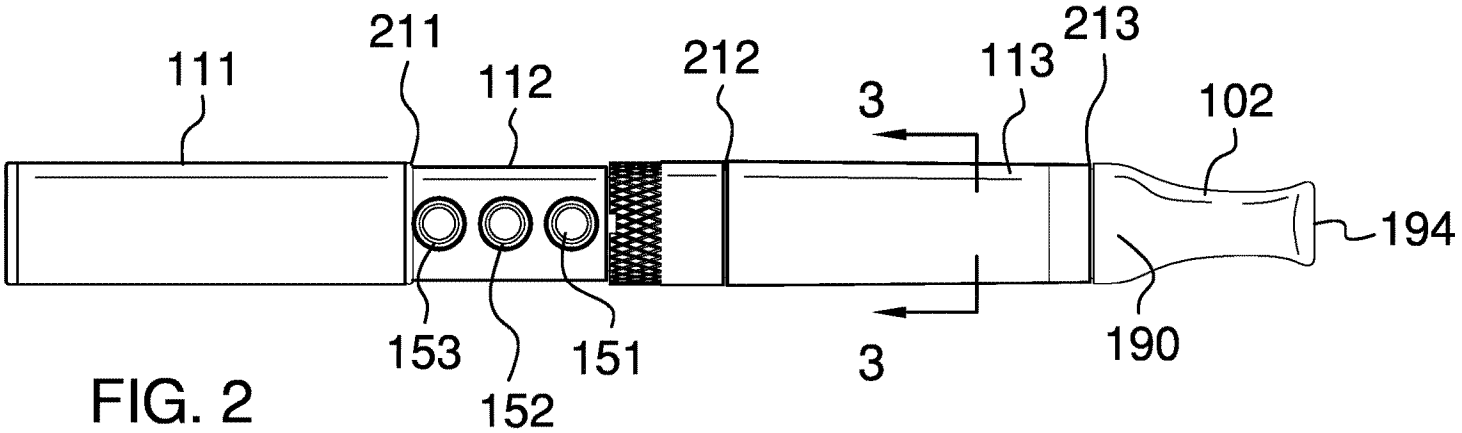
FIG. 2 is a top view of an embodiment of the disclosure.
Figure 3:
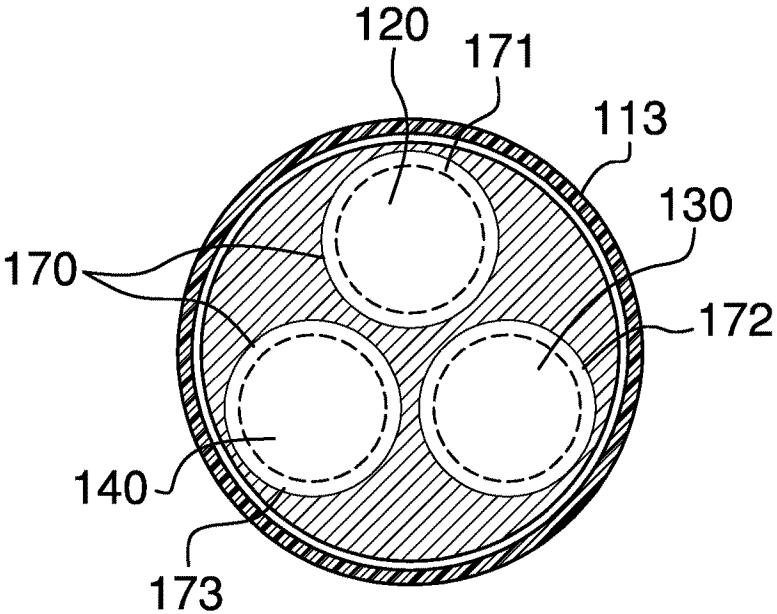
FIG. 3 is a detail view of an embodiment of the disclosure.
Figure 4:
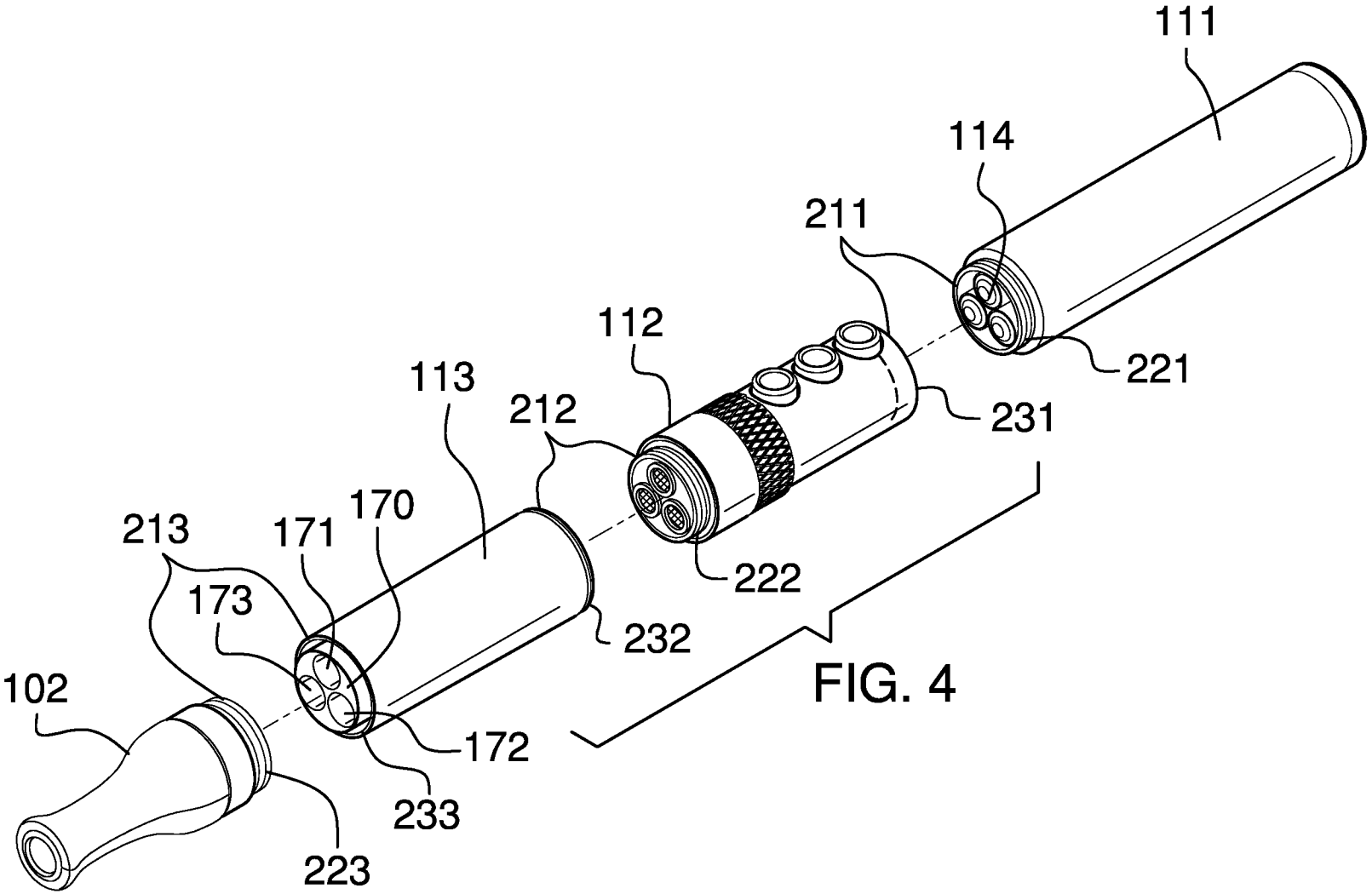
FIG. 4 is an exploded view of an embodiment of the disclosure.
Figure 5:
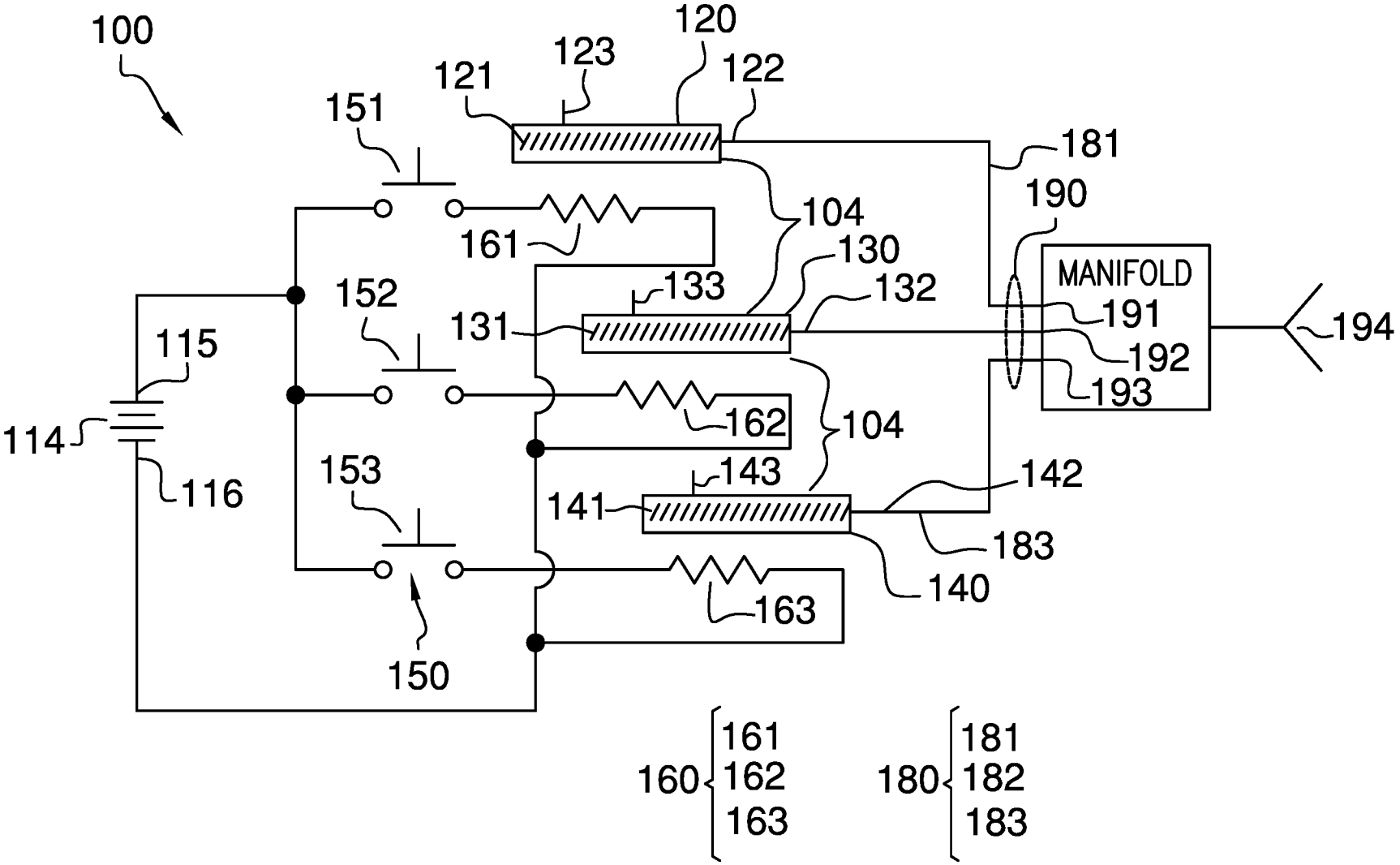
FIG. 5 is a block diagram of an embodiment of the disclosure.

Detailed reference will now be made to one or more potential embodiments of the disclosure, which are illustrated in FIGS. 1 through 5.

The personal vaporizer having multiple liquid-holding reservoirs 100 (hereinafter invention) is a vaporizing device. The invention 100 vaporizes a smoking material used to simulate the smoking experience. Specifically, the invention 100 generates a consumable substance in a gas phase. The gas phase of the consumable substance is assumed to be a pharmacologically active media. The consumable substance is contained within a cartridge. The cartridge is selected from a plurality of cartridges 104 that are contained within the invention 100. Each cartridge contained within the invention 100 contains a different consumable substance. The invention 100 allows a user to select the desired consumable substance from an appropriate cartridge selected from the plurality of cartridges 104.

The invention 100 comprises a plurality of containment prisms 101, a manifold 102, a plurality of threaded connections containment prisms 101 contain the plurality of cartridges 104 and the mechanisms required to process the consumable substance. The process is selected from the group consisting of evaporating the consumable substance and sublimating the consumable substance. The manifold 102 creates a fluidic connection between the plurality of cartridges 104 and the user of the plurality of cartridges 104. The plurality of threaded connections 103 interconnect the plurality of containment prisms 101. The plurality of threaded connections 103 attach the manifold 102 to the plurality of containment prisms 101.

Each of the plurality of containment prisms 101 is a rigid tubular structure. Each of the plurality of containment prisms 101 is a prism-shaped structure. Each of the plurality of containment prisms 101 is a modular structure. The plurality of containment prisms 101 contains the plurality of cartridges 104. The plurality of containment prisms 101 converts a consumable substance selected from the plurality of cartridges 104 into a gas phase that is consumed as a smoking material. The plurality of threaded connections 103 assembles the plurality of containment prisms 101. The plurality of containment prisms 101 comprises a battery prism 111, a heating prism 112, and a storage prism 113.

The battery prism 111 is a rigid tubular structure. The contains the battery structure 114 used to provide electrical power to process a consumable substance selected from the plurality of cartridges 104. The battery prism 111 comprises a battery structure 114. The battery structure 114 is further defined with a positive terminal 115 and a negative terminal 116.

The battery structure 114 comprises one or more commercially available batteries. The battery structure 114 forms a chemical structure that converts chemical potential energy into the electrical energy needed to process the consumable substances contained in the plurality of cartridges 104. The positive terminal 115 is the lead of the battery structure 114 that feeds electrical current into the heating prism 112. The negative terminal 116 is the lead of the battery structure 114 that receives the electrical current returning from the heating prism 112.

The heating prism 112 is a rigid tubular structure. The ends of the prism structure of the heating prism 112 are geometrically similar to the battery prism 111. The heating prism 112 draws electricity from the battery structure 114 of the battery prism 111 to heat a consumable substance selected from the plurality of cartridges 104. The heating prism 112 further provides a mechanism to select the cartridge containing comprises a plurality of activation switches 150 and a plurality of heating elements 160.

Each of the plurality of activation switches 150 is a momentary switch. Each of the plurality of activation switches 150 controls the flow of electricity from the battery structure 114 to a heating element selected from the plurality of heating elements 160. The plurality of activation switches 150 comprises a first activation switch 151, a second activation switch 152, and a third activation switch 153.

The first activation switch 151 is a momentary switch that controls the flow of electricity into the first heating element 161. The second activation switch 152 is a momentary switch that controls the flow of electricity into the second heating element 162. The third activation switch 153 is a momentary switch that controls the flow of electricity into the third heating element 163.

Each of the plurality of heating elements 160 is a commercially available resistive heating device. The use of a heating element is well-known and documented in the electrical arts. Each of the plurality of heating elements 160 heats a consumable substance such that the consumable substance is processed into a gas phase for consumption. The plurality of heating elements 160 comprises a first heating element 161, a The first heating element 161 heats the first consumable substance 121 contained in the first cartridge 120 into a gas phase. The second heating element 162 heats the second consumable substance 131 contained in the second cartridge 130 into a gas phase. The third heating element 163 heats the third consumable substance 141 contained in the third cartridge 140 into a gas phase.

The storage prism 113 is a rigid tubular structure. The ends of the prism structure of the storage prism 113 are geometrically similar to the battery prism 111. The storage prism 113 contains the plurality of cartridges 104. The storage prism 113 forms a plurality of fluidic connections 180 that transport the consumable substance in a gas phase from each of the plurality of cartridges 104 to the manifold 102. The storage prism 113 comprises a plurality of chambers 170 and a plurality of fluidic connections 180.

Each of the plurality of chambers 170 is a segregated negative space that is formed in the storage prism 113. Each of the plurality of chambers 170 forms a segregated housing. Each of the plurality of chambers 170 is associated a cartridge selected from the plurality of cartridges 104. Each of the plurality of chambers 170 is geometrically similar to its associated cartridge the selected chamber contains the formed with all apertures and form factors necessary to allow the selected chamber to accommodate the use and operation of the associated cartridge. Methods to form a chamber suitable for the purposes described in this disclosure are well-known and documented in the mechanical arts. The plurality of chambers 170 comprises a first chamber 171, a second chamber 172, and a third chamber 173.

The first chamber 171 is the chamber selected from the plurality of chambers 170 that is associated with the first cartridge 120 of the plurality of cartridges 104. The second chamber 172 is the chamber selected from the plurality of chambers 170 that is associated with the second cartridge 130 of the plurality of cartridges 104. The third chamber 173 is the chamber selected from the plurality of chambers 170 that is associated with the third cartridge 140 of the plurality of cartridges 104.

Each of the plurality of fluidic connections 180 forms a fluidic connection between the exhaust vent of a cartridge selected from the plurality of cartridges 104 to an intake selected from the plurality of intakes 190 of the manifold 102. Each of the plurality of fluidic connections 180 transports the gas phase of the consumable substance contained within the selected cartridge to the manifold 102. The plurality of fluidic connections 180 comprises a first fluidic connection 181, a second fluidic connection 182, and a third fluidic connection 183.

The manifold 102 is a mechanical structure. The manifold 102 draws the consumable substance in a gas phase out of the plurality of containment prisms 101 and transports the consumable substance in a gas phase to a port referred to as the mouthpiece 194 for consumption. The manifold 102 merges consumable substances in a gas phase from multiple sources into a single gas phase flow for consumption. The plurality of threaded connections 103 attaches the manifold to the plurality of containment prisms 101. The manifold 102 comprises a plurality of intakes 190 and a mouthpiece 194. The plurality of intakes 190 comprises a first intake 191, a second intake 192, and a third intake 193.

Each of the plurality of intakes 190 is a port formed in the manifold that receives the gas phase of a consumable substance contained within a cartridge selected from the plurality of cartridges 104. The plurality of intakes 190 aggregates the gas phase of each consumable substance delivered to the plurality of intakes 190 into a single flow before delivery to the mouthpiece 194. The first intake 191 receives the gas phase of the first consumable substance 121 from the first cartridge 120. The second intake 192 receives the gas phase of the second consumable substance 131 from the second cartridge 130. The third intake 193 receives the gas phase of the third consumable substance 141 from the third cartridge 140.

The mouthpiece 194 is a port through which the gas phase of a consumable substance is withdrawn as part of the smoking process.

Each of the plurality of cartridges 104 is a containment structure. Each of the plurality of cartridges 104 contains a consumable substance. The consumable substance is a pharmacologically active media used as a smoking material. Each of the plurality of cartridges 104 is contained within the plurality of containment prisms 101 such that the plurality of containment prisms 101 processes the consumable substance into a gas phase while the consumable substance is in its associated cartridge. By processing is meant that the consumable substance undergoes a process selected from the group consisting of: a) evaporating the consumable substance while in its associated cartridge; and, b) sublimating the consumable substance while in its associated cartridge.

Any first consumable substance 121 stored in any first cartridge 120 selected from the plurality of cartridges 104 is segregated from any subsequent consumable substance contained in any subsequent cartridge selected from the plurality of cartridges 104 while the first consumable substance 121 remains in a liquid or solid phase. The consumable substances contained in each of the plurality of cartridges 104 need not be identical. The consumable substances contained in each of the plurality of cartridges 104 need not be different.

The plurality of cartridges 104 comprises a first cartridge 120, a second cartridge 130, and a third cartridge 140.

The first cartridge 120 is a fluid impermeable containment structure. The first cartridge 120 is stored within the storage prism 113. The first cartridge 120 comprises a first consumable substance 121, a first exhaust vent 122, and a first make-up vent 123.

The first cartridge 120 contains the first consumable substance 121. The first consumable substance 121 is a pharmacologically active media that is inhaled as a part of the smoking process. The first consumable substance 121 is a commercially available substance. The first exhaust vent 122 in an aperture that is formed in the first cartridge 120. The gas phase of the first consumable substance 121 is drawn out of the first exhaust vent 122 and through the plurality of fluidic connections 180 into the plurality of intakes 190 of the manifold 102. The first make-up vent 123 is a vent that forms a fluidic connection between the first cartridge 120 and the atmosphere. The first make-up vent 123 allows for the flow of atmospheric gas into the first cartridge 120 such that the atmospheric gas replaces the gas phase of the first consumable substance 121 that was drawn out of the first cartridge 120.

The second cartridge 130 is a fluid impermeable containment structure. The second cartridge 130 is stored within the storage prism 113. The second cartridge 130 comprises a second consumable substance 131, a second exhaust vent 132, and a second make-up vent 133.

The second cartridge 130 contains the second consumable substance 131. The second consumable substance 131 is a pharmacologically active media that is inhaled as a part of the smoking process. The second consumable substance 131 is a commercially available substance. The second exhaust vent 132 in an aperture that is formed in the second cartridge 130. The gas phase of the second consumable substance 131 is drawn out of the second exhaust vent 132 and through the plurality of fluidic connections 180 into the plurality of intakes 190 of the manifold 102. The second make-up vent 133 is a vent that forms a fluidic connection between the second cartridge 130 and the atmosphere. The second make-up vent 133 allows for the flow of atmospheric gas into the second cartridge 130 such that the atmospheric gas replaces the gas phase of the second consumable substance 131 that was drawn out of the second cartridge 130.

The third cartridge 140 comprises a third consumable substance 141, a third exhaust vent 142, and a third make-up vent 143. The third cartridge 140 is a fluid impermeable containment structure. The third cartridge 140 is stored within the storage prism 113.

The third cartridge 140 contains the third consumable substance 141. The third consumable substance 141 is a pharmacologically active media that is inhaled as a part of the smoking process. The third consumable substance 141 is a commercially available substance. The third exhaust vent 142 in an aperture that is formed in the third cartridge 140. The gas phase of the third consumable substance 141 is drawn out of the third exhaust vent 142 and through the plurality of fluidic connections 180 into the plurality of intakes 190 of the manifold 102. The third make-up vent 143 is a vent that forms a fluidic connection between the third cartridge 140 and the atmosphere. The third make-up vent 143 allows for the flow of atmospheric gas into the third cartridge 140 such that the atmospheric gas replaces the gas phase of the third consumable substance 141 that was drawn out of the third cartridge 140.

Each of the plurality of threaded connections 103 is a threaded connection used to assemble the invention 100. The threaded connection is a well-known and documented fastening structure. The threaded connection is defined in greater detail elsewhere in this disclosure. The plurality of threaded connections 103 comprises a first threaded connection 211, a second threaded connection 212, and a third threaded connection 213.

The first threaded connection 211 comprises a first exterior screw thread 221 and a first interior screw thread 231. The first interior screw thread 231 is a helical structure that screws into a helical structure formed by the first exterior screw thread 221. The second threaded connection 212 comprises a second exterior screw thread 222 and a second interior screw thread 232. The second interior screw thread 232 is a helical structure that screws into a helical structure formed by the second exterior screw thread 222. The third threaded connection 213 comprises a third exterior screw thread 223 and a third interior screw thread 233. The third interior screw thread 233 is a helical structure that screws into a helical structure formed by the third exterior screw thread 223. The terms interior screw thread and exterior screw thread are defined in greater detail elsewhere in this disclosure.

The following seven paragraphs describe the assembly of the invention 100.

The first exterior screw thread 221 is formed on the open end of the prism structure of the battery prism 111. The first interior screw thread 231 is formed on an end of the prism structure of the heating prism 112. The second exterior screw thread 222 is formed on an end of the prism structure of the heating prism 112. The second interior screw thread 232 is formed on an end of the prism structure of the storage prism 113. The third interior screw thread 233 is formed on an end of the prism structure of the storage prism 113. The third exterior screw thread 223 is formed on the end of the manifold 102 that is distal from the mouthpiece 194.

The battery prism 111 contains the battery structure 114. The heating prism 112 contains the plurality of activation switches 150 and the plurality of heating elements 160. The storage prism 113 contains the plurality of chambers 170. The plurality of chambers 170 contain the first cartridge 120, the second cartridge 130, and the third cartridge 140. The first cartridge 120 inserts into the first chamber 171. The second cartridge 130 inserts into the second chamber 172. The third cartridge 140 inserts into the third chamber 173.

The first threaded connection 211 attaches the battery prism 111 to the heating prism 112 by screwing the first exterior screw thread 221 into the first interior screw thread 231. The second threaded connection 212 attaches the heating prism 112 to the storage prism 113 by screwing the second exterior screw thread 222 into the second interior screw thread 232. The third threaded connection 213 attaches the storage prism 113 to the manifold 102 by screwing the third exterior screw thread 223 into the third interior screw thread 233.

The first chamber 171 is positioned in the heating prism 112 such that the first heating element 161 heats the first cartridge 120. The second chamber 172 is positioned in the heating prism 112 such that the second heating element 162 heats the second cartridge 130. The third chamber 173 is positioned in the heating prism 112 such that the third heating element 163 heats the third cartridge 140.

The first fluidic connection 181 attaches the first exhaust vent 122 of the first cartridge 120 to the first intake 191 of the plurality of intakes 190. The second fluidic connection 182 attaches the second exhaust vent 132 of the second cartridge 130 to the second intake 192 of the plurality of intakes 190. The third fluidic connection 183 attaches the third exhaust vent 142 of the third cartridge 140 to the third intake 193 of the plurality of intakes 190.

The first activation switch 151 forms a series electrical connection between the positive terminal 115 of the battery structure 114 and the first heating element 161 such that the first activation switch 151 controls the flow of electricity through the first heating element 161. The second activation switch 152 forms a series electrical connection between the positive terminal 115 of the battery structure 114 and the second heating element 162 such that the second activation switch 152 controls the flow of electricity through the second heating element 162. The third activation switch 153 forms a series electrical connection between the positive terminal 115 of the battery structure 114 and the third heating element 163 such that the third activation switch 153 controls the flow of electricity through the third heating element 163.

The first heating element 161 forms a series electrical connection between the first activation switch 151 and the negative terminal 116 of the battery structure 114. The second heating element 162 forms a series electrical connection between the second activation switch 152 and the negative terminal 116 of the battery structure 114. The third heating element 163 forms a series electrical connection between the third activation switch 153 and the negative terminal 116 of the battery structure 114.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Battery: As used in this disclosure, a battery is a chemical device consisting of one or more cells, in which chemical energy is converted into electricity and used as a source of power. Batteries are commonly defined with a positive terminal and a negative terminal.

Capped Pipe: As used in this disclosure, a capped pipe is a pipe with one closed end and one open end.

Cartridge: As used in this disclosure, a cartridge is a device used to contain an object or material in a manner suitable for use by a mechanical device. A cartridge will removably insert into the mechanical device such that the mechanical device can use the object or material as part of the process performed by the mechanical device. The cartridge is removed from the mechanical device once the object or material has been consumed.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chamber: As used in this disclosure, a chamber is an enclosed or enclosable negative space that is dedicated to a purpose.

Channel: As used in this disclosure, a channel is a prism-shaped passage through which an object or fluid is passed through.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object. Always use Geometrically similar, correspond and one to one Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. Specifically, the sum of the surface areas of two ends of the prism-shaped object that forms the disk is greater than the surface area of lateral face of the prism-shaped object that forms the disk. In this disclosure, the ends of the prism-shaped structure that forms the disk are referred to as the faces of the disk.

Evaporation: As used in this disclosure, evaporation refers to the phase transition of a compound from a liquid phase to a gas phase.

Exterior Screw Thread: An exterior screw thread is a ridge wrapped around the outer surface of a tube in the form of a helical structure that is used to convert rotational movement into linear movement.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connection are well-known and documented in the mechanical, chemical, and plumbing arts.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Heating Element: As used in this disclosure, a heating element is a resistive wire that is used to convert electrical energy into heat. Common metal combinations used to form heat elements include a combination of nickel and Chromium (typical: 80/20), a combination of iron, chromium and aluminum (typical 70/25/5), a combination of copper, nickel, iron, and manganese (typical 66/30/2/2) (use for continuously hot), or platinum.

Housing: As used in this disclosure, a housing is a rigid casing that encloses and protects one or more devices.

Interior Screw Thread: An interior screw thread is a groove that is formed around the inner surface of a tube in the form of a helical structure that is used to convert rotational movement into linear movement.

Lead: As used in this disclosure, a lead is a conductor that is physically used to electrically connect an electrical component into a larger circuit assembly.

Liquid: As used in this disclosure, a liquid refers to a state (phase) of matter that is fluid and that maintains, for a given pressure, a fixed volume that is independent of the volume of the container.

Make-Up Air: As used in this disclosure, make-up air is air that permitted to enter an enclosed space to replace air that has been evacuated in some manner, for example by a fan, from the enclosed space.

Manifold: As used in this disclosure, a manifold is a pipe or chamber having several ports through which liquid or gas is gathered or distributed.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Mouthpiece: As used in this disclosure, a mouthpiece is a structure designed to have lips placed against it. The mouthpiece transports a gas into and out of the mouth of a person.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pharmacologically Active Media: As used in this disclosure, a pharmacologically active media refers to a chemical substance that has a biochemical or physiological effect on a biological organism.

Phase: As used in this disclosure, phase refers to the state of the form of matter. The common states of matter are solid, liquid, gas, and plasma.

Pipe: As used in this disclosure, a pipe is a hollow prism-shaped device that is suitable for use in transporting a fluid. The line that connects the center of the first base of the prism to the center of the second base of the prism is referred to as the axis of the prism or the centerline of the pipe. When two pipes share the same centerline they are said to be aligned. In this disclosure, the terms inner dimension of a pipe and outer dimension are used as they would be used by those skilled in the plumbing arts.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rigid Structure: As used in this disclosure, a rigid structure is a solid structure formed from an inelastic material that resists changes in shape. A rigid structure will permanently deform as it fails under a force.

Screw: As used in this disclosure, to screw is a verb meaning: 1) to fasten or unfasten (unscrew) a threaded connection; or 2) to attach a helical structure to a solid structure.

Smoking Material: As used in this disclosure, smoking materials are combustible materials that are intended to be deeply inhaled as the smoking material burns. This definition is intended to include, but is not limited to, tobacco and materials that exhibit pharmacological activity such as marijuana. This definition is intended to include vaporizing devices commonly used to evaporate or sublimate materials into a gas phase that simulate the smoking experience. This definition is intended to exclude combustible materials that are burned as a perfume but that are generally not purposefully inhaled including, but not limited to, incense and scented oils.

Sublimation: As used in this disclosure, sublimation refers to a phase transition directly from a solid phase to a gas phase in a manner that bypasses the liquid phase.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Threaded Connection: As used in this disclosure, a threaded connection is a type of fastener that is used to join a first tube-shaped and a second tube-shaped object together. The first tube-shaped object is fitted with a first fitting selected from an interior screw thread or an exterior screw thread. The second tube-shaped object is fitted with the remaining screw thread. The tube-shaped object fitted with the exterior screw thread is placed into the remaining tube-shaped object such that: 1) the interior screw thread and the exterior screw thread interconnect; and, 2) when the tube-shaped object fitted with the exterior screw thread is rotated the rotational motion is converted into linear motion that moves the tube-shaped object fitted with the exterior screw thread either into or out of the remaining tube-shaped object. The direction of linear motion is determined by the direction of rotation.

Tube: As used in this disclosure, the term tube is used to describe a rigid hollow prism with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Vaporizing Device: As used in this disclosure, a vaporizing device is a device that evaporates or sublimates a material into a gas phase that simulates the smoking experience.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A simulated smoking device comprising:

a plurality of containment prisms, a manifold, a plurality of threaded connections, and the plurality of cartridges;

wherein the manifold creates a fluidic connection with the plurality of cartridges;

wherein the plurality of threaded connections interconnect the plurality of containment prisms;

wherein the plurality of threaded connections attach the manifold to the plurality of containment prisms;

wherein the plurality of containment prisms contain the plurality of cartridges;

wherein the simulated smoking device is a vaporizing device;

wherein the simulated smoking device vaporizes a smoking material that is subsequently used to simulate a smoking experience;

wherein the simulated smoking device generates a consumable substance in a gas phase;

wherein the consumable substance is contained within a cartridge;

wherein the cartridge is selected from the plurality of cartridges;

wherein the simulated smoking device allows a user to select the desired consumable substance from an appropriate cartridge selected from the plurality of cartridges;

wherein a process is selected from a group consisting of evaporating the consumable substance and sublimating the consumable substance;

wherein each of the plurality of containment prisms is a rigid tubular structure;

wherein each of the plurality of containment prisms is a prism-shaped structure;

wherein each of the plurality of containment prisms is a modular structure;

wherein the plurality of containment prisms converts a consumable substance selected from the plurality of cartridges into a gas phase that is consumed as a smoking material;

wherein the manifold draws the consumable substance in a gas phase out of the plurality of containment prisms;

wherein the manifold merges the consumable substances in a gas phase from multiple sources into a single gas phase flow for consumption;

wherein the manifold comprises a plurality of intakes and a mouthpiece;

wherein the plurality of intakes forms a fluidic connection with the mouthpiece;

wherein the plurality of intakes merges the consumable substances in a gas phase a single gas phase flow for consumption.

2. The simulated smoking device according to claim 1 wherein each of the plurality of cartridges is a containment structure;

wherein each of the plurality of cartridges contains a consumable substance;

wherein each of the plurality of cartridges is contained within the plurality of containment prisms such that the plurality of containment prisms processes the consumable substance into a gas phase while the consumable substance is in its associated cartridge;

wherein by processing is meant that the consumable substance undergoes a process selected from the group consisting of: a) evaporating the consumable substance while in its associated cartridge; and, b) sublimating the consumable substance while in its associated cartridge.

3. The simulated smoking device according to claim 2 wherein any primary consumable substance stored in any primary cartridge selected from the plurality of cartridges is segregated from any subsequent consumable substance contained in any subsequent cartridge selected from the plurality of cartridges while the primary consumable substance remains in a liquid or solid phase.

4. The simulated smoking device according to claim 3 wherein the plurality of containment prisms comprises a battery prism, a heating prism, and a storage prism;

wherein the heating prism attaches the battery prism to the storage prism wherein the battery prism is a rigid tubular structure;

wherein the battery prism has capped pipe shape;

wherein the heating prism is a rigid tubular structure;

wherein the ends of the prism structure of the heating prism are geometrically similar to the battery prism;

wherein the heating prism draws electricity from the battery prism to heat a consumable substance selected from the plurality of cartridges;

wherein the heating prism further provides a mechanism to select the cartridge containing the desired consumable substance;

wherein the storage prism is a rigid tubular structure;

wherein the ends of the prism structure of the storage prism are geometrically similar to the battery prism;

wherein the storage prism contains the plurality of cartridges;

wherein the storage prism forms a plurality of fluidic connections that transport the consumable substance in a gas phase from each of the plurality of cartridges to the manifold.

5. The simulated smoking device according to claim 4 wherein the battery prism comprises a battery structure;

wherein the battery structure is further defined with a positive terminal and a negative terminal;

wherein the battery structure forms a chemical structure that converts chemical potential energy into the electrical energy needed to process the consumable substances contained in the plurality of cartridges;

wherein the positive terminal is the lead of the battery structure that feeds electrical current into the heating prism;

wherein the negative terminal is the lead of the battery structure that receives the electrical current returning from the heating prism.

6. The simulated smoking device according to claim 5 wherein the heating prism comprises a plurality of activation switches and a plurality of heating elements;

wherein the plurality of activation switches and the plurality of heating elements are electrically interconnected.

7. The simulated smoking device according to claim 6 wherein each of the plurality of activation switches is a momentary switch;

wherein each of the plurality of activation switches controls the flow of electricity from the battery structure to a heating element selected from the plurality of heating elements;

wherein each of the plurality of heating elements is a resistive heating device;

wherein each of the plurality of heating elements heats a consumable substance such that the consumable substance is processed into a gas phase for consumption.

8. The simulated smoking device according to claim 7 wherein the storage prism comprises a plurality of chambers and a plurality of fluidic connections;

wherein the plurality of fluidic connections attaches the plurality of chambers to the manifold;

wherein each of the plurality of chambers is a segregated negative space that is formed in the storage prism;

wherein each of the plurality of chambers is associated a cartridge selected from the plurality of cartridges;

wherein each of the plurality of chambers is geometrically similar to its associated cartridge the selected chamber contains the associated cartridge.

9. The simulated smoking device according to claim 8 wherein each of the plurality of fluidic connections forms a fluidic connection between a cartridge selected from the plurality of cartridges to an intake selected from the plurality of intakes of the manifold;

wherein each of the plurality of fluidic connections transports the gas phase of the consumable substance contained within the selected cartridge to the manifold.

10. The simulated smoking device according to claim 9 wherein the plurality of cartridges comprises a first cartridge, a second cartridge, and a third cartridge;

wherein the first cartridge is a fluid impermeable containment structure;

wherein the first cartridge is stored within the storage prism;

wherein the second cartridge is a fluid impermeable containment structure;

wherein the second cartridge is stored within the storage prism;

wherein the third cartridge is a fluid impermeable containment structure;

wherein the third cartridge is stored within the storage prism.

11. The simulated smoking device according to claim 10 wherein the first cartridge comprises a first consumable substance, a first exhaust vent, and a first make-up vent;

wherein the second cartridge comprises a second consumable substance, a second exhaust vent, and a second make-up vent;

wherein the third cartridge comprises a third consumable substance, a third exhaust vent, and a third make-up vent;

wherein the first cartridge contains the first consumable substance;

wherein the first exhaust vent in an aperture that is formed in the first cartridge;

wherein the gas phase of the first consumable substance is drawn out of the first exhaust vent and through the plurality of fluidic connections into the plurality of intakes of the manifold;

wherein the first make-up vent is a vent that forms a fluidic connection between the first cartridge and the atmosphere;

wherein the second cartridge contains the second consumable substance;

wherein the second exhaust vent in an aperture that is formed in the second cartridge;

wherein the gas phase of the second consumable substance is drawn out of the second exhaust vent and through the plurality of fluidic connections into the plurality of intakes of the manifold;

wherein the second make-up vent is a vent that forms a fluidic connection between the second cartridge and the atmosphere;

wherein the third cartridge contains the third consumable substance;

wherein the third exhaust vent in an aperture that is formed in the third cartridge;

wherein the gas phase of the third consumable substance is drawn out of the third exhaust vent and through the plurality of fluidic connections into the plurality of intakes of the manifold;

wherein the third make-up vent is a vent that forms a fluidic connection between the third cartridge and the atmosphere.

12. The simulated smoking device according to claim 11 wherein the plurality of threaded connections comprises a first threaded connection, a second threaded connection, and a third threaded connection;

wherein the first threaded connection comprises a first exterior screw thread and a first interior screw thread;

wherein the first interior screw thread is a helical structure that screws into a helical structure formed by the first exterior screw thread;

wherein the second threaded connection comprises a second exterior screw thread and a second interior screw thread;

wherein the second interior screw thread is a helical structure that screws into a helical structure formed by the second exterior screw thread;

wherein the third threaded connection comprises a third exterior screw thread and a third interior screw thread;

wherein the third interior screw thread is a helical structure that screws into a helical structure formed by the third exterior screw thread.

13. The simulated smoking device according to claim 12 wherein the plurality of activation switches comprises a first activation switch, a second activation switch, and a third activation switch;

wherein the first activation switch is a momentary switch that controls the flow of electricity into the first heating element;

wherein the second activation switch is a momentary switch that controls the flow of electricity into the second heating element;

wherein the third activation switch is a momentary switch that controls the flow of electricity into the third heating element.

14. The simulated smoking device according to claim 13 wherein the plurality of heating elements comprises a first heating element, a second heating element, and a third heating element;

wherein the first heating element heats the first consumable substance contained in the first cartridge into a gas phase;

wherein the second heating element heats the second consumable substance contained in the second cartridge into a gas phase;

wherein the third heating element heats the third consumable substance contained in the third cartridge into a gas phase.

15. The simulated smoking device according to claim 14 wherein the plurality of chambers comprises a first chamber, a second chamber, and a third chamber;

wherein the first chamber is the chamber selected from the plurality of chambers that is associated with the first cartridge of the plurality of cartridges;

wherein the second chamber is the chamber selected from the plurality of chambers that is associated with the second cartridge of the plurality of cartridges;

wherein the third chamber is the chamber selected from the plurality of chambers that is associated with the third cartridge of the plurality of cartridges.

16. The simulated smoking device according to claim 15 wherein each of the plurality of intakes is a port formed in the manifold that receives the gas phase of a consumable substance contained within a cartridge selected from the plurality of cartridges;

wherein the plurality of intakes comprises a first intake, a second intake, and a third intake;

wherein the first intake receives the gas phase of the first consumable substance from the first cartridge;

wherein the second intake receives the gas phase of the second consumable substance from the second cartridge;

wherein the third intake receives the gas phase of the third consumable substance from the third cartridge.

17. The simulated smoking device according to claim 16 wherein the first exterior screw thread is formed on the open end of the prism structure of the battery prism;

wherein the first interior screw thread is formed on an end of the prism structure of the heating prism;

wherein the second exterior screw thread is formed on an end of the prism structure of the heating prism;

wherein the second interior screw thread is formed on an end of the prism structure of the storage prism;

wherein the third interior screw thread is formed on an end of the prism structure of the storage prism;

wherein the third exterior screw thread is formed on the end of the manifold that is distal from the mouthpiece;

wherein the battery prism contains the battery structure;

wherein the heating prism contains the plurality of activation switches and the plurality of heating elements;

wherein the storage prism contains the plurality of chambers;

wherein the plurality of chambers contain the first cartridge, the second cartridge, and the third cartridge;

wherein the first cartridge inserts into the first chamber;

wherein the second cartridge inserts into the second chamber;

wherein the third cartridge inserts into the third chamber;

wherein the first threaded connection attaches the battery prism to the heating prism by screwing the first exterior screw thread into the first interior screw thread;

wherein the second threaded connection attaches the heating prism to the storage prism by screwing the second exterior screw thread into the second interior screw thread;

wherein the third threaded connection attaches the storage prism to the manifold by screwing the third exterior screw thread into the third interior screw thread;

wherein the first chamber is positioned in the heating prism such that the first heating element heats the first cartridge;

wherein the second chamber is positioned in the heating prism such that the second heating element heats the second cartridge;

wherein the third chamber is positioned in the heating prism such that the third heating element heats the third cartridge;

wherein the plurality of fluidic connections comprises a first fluidic connection, a second fluidic connection, and a third fluidic connection;

wherein the first fluidic connection attaches the first exhaust vent of the first cartridge to the first intake of the plurality of intakes;

wherein the second fluidic connection attaches the second exhaust vent of the second cartridge to the second intake of the plurality of intakes;

wherein the third fluidic connection attaches the third exhaust vent of the third cartridge to the third intake of the plurality of intakes.

18. The simulated smoking device according to claim 17 wherein the first activation switch forms a series electrical connection between the positive terminal of the battery structure and the first heating element such that the first activation switch controls the flow of electricity through the first heating element;

wherein the second activation switch forms a series electrical connection between the positive terminal of the battery structure and the second heating element such that the second activation switch controls the flow of electricity through the second heating element;

wherein the third activation switch forms a series electrical connection between the positive terminal of the battery structure and the third heating element such that the third activation switch controls the flow of electricity through the third heating element;

wherein the first heating element forms a series electrical connection between the first activation switch and the negative terminal of the battery structure;

wherein the second heating element forms a series electrical connection between the second activation switch and the negative terminal of the battery structure;

wherein the third heating element forms a series electrical connection between the third activation switch and the negative terminal of the battery structure.

* * * * *